US005737773A

United States Patent [19]

Dicker et al.

[11] Patent Number: 5,737,773

[45] Date of Patent: Apr. 14, 1998

[54] AEROBIC EXERCISE GARMENT

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 802,973

[22] Filed: Feb. 20, 1997

[51] Int. Cl.[6] ..... A41B 1/00; A41D 13/02

[52] U.S. Cl. ..... 2/69; 2/79; 2/115; 482/105

[58] Field of Search ..... 2/69, 79, 228, 2/238, 170, 108, 115, 102, 70, 227; 482/105, 121, 124, 131, 74; 450/104

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 3,411,500 | 11/1968 | Gatts . | |
| 3,559,654 | 2/1971 | Pope . | |
| 3,759,510 | 9/1973 | Jackson . | |
| 4,065,814 | 1/1978 | Fox . | |
| 4,220,299 | 9/1980 | Motter . | |
| 4,325,379 | 4/1982 | Ozbey . | |
| 4,384,369 | 5/1983 | Prince . | |
| 4,670,913 | 6/1987 | Morell . | |
| 4,698,847 | 10/1987 | Yoshihara . | |
| 4,910,802 | 3/1990 | Malloy . | |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz . | |
| 5,060,315 | 10/1991 | Ewing . | |
| 5,062,642 | 11/1991 | Berry . | |
| 5,109,546 | 5/1992 | Dicker | 2/69 |
| 5,141,223 | 8/1992 | Block . | |
| 5,176,600 | 1/1993 | Wilkinson . | |
| 5,186,701 | 2/1993 | Wilkinson . | |
| 5,201,074 | 4/1993 | Dicker | 2/69 |
| 5,203,754 | 4/1993 | MacLean . | |
| 5,256,119 | 10/1993 | Tudor . | |
| 5,263,916 | 11/1993 | Bobich . | |
| 5,267,928 | 12/1993 | Barile . | |
| 5,282,277 | 2/1994 | Onozawa . | |
| 5,306,222 | 4/1994 | Wilkinson | 482/121 |
| 5,308,305 | 5/1994 | Romney . | |
| 5,336,139 | 8/1994 | Miller . | |
| 5,357,637 | 10/1994 | Moore . | |
| 5,367,708 | 11/1994 | Fujimoto | 2/69 |
| 5,372,565 | 12/1994 | Burdenko . | |
| 5,375,610 | 12/1994 | Lacourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,570,472 | 11/1996 | Dicker | 2/69 |

*Primary Examiner*—Gloria Hale
*Attorney, Agent, or Firm*—Connolly & Hutz

[57] ABSTRACT

An aerobic exercise garment includes a body section and limb sections. The garment includes a base fabric which incorporates elastic resistance band material having a direction of stretch. The elastic resistance band material is formed with a minimal number of pieces and is incorporated in the garment by securing the pieces together at locations which do not interfere with the direction of resistance.

26 Claims, 3 Drawing Sheets

AEROBIC EXERCISE GARMENT

BACKGROUND OF THE INVENTION

Various garments have been suggested which include elastic elements to provide a resistance to an activity which would require swinging or bending of the arms or legs or the bending of various body parts. Examples of such garments are found in U.S. Pat. Nos. 5,109,546, 5,176,600, 5,186,701, 5,201,074, 5,306,222 and 5,570,472.

SUMMARY OF THE INVENTION

An object of this invention is to provide aerobic resistance garments which include elastic bands as part of the garment.

A further object of this invention is to provide an exercise garment which incorporates elastic resistance panels having a direction of stretch. The resistance panels are secured to the remainder of the garment in such a way that the securement does not interfere with the stretch.

In accordance with this invention the garment includes sections which would have different elastic characteristics so as to provide the resistance bands which require a greater resistance force to be overcome by the user while wearing the garment. The other sections of the garment are secured together to form a basic unit and the resistance bands are then incorporated into the unit.

The garment of this invention preferably includes a pants section having a body portion and leg portions and having suspender portions. A single elastic band extends from one side of the suspender portion completely down the body and leg portions on the front and rear of the pants so as to minimize the number of pieces and to avoid interference with the performance of the elastic bands.

THE DRAWINGS

DETAILED DESCRIPTION

Figure 1:
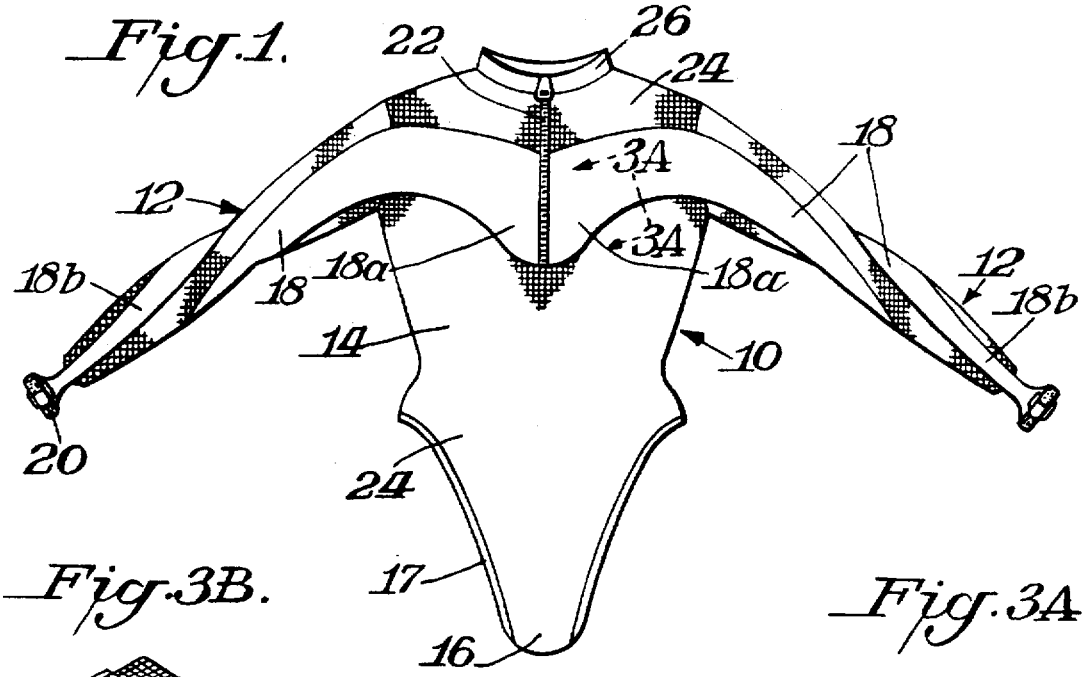
FIG. 1 is a front elevational view of one portion of an aerobic resistance garment made in accordance with this invention.

The present invention relates to manufacturing techniques for incorporating elastic resistance bands into aerobic resistance garments. Reference is made to U.S. Pat. Nos. 5,109,546, 5,176,600, 5,186,701, 5,201,074, 5,306,222 and 5,570,472, all of the details of which are incorporated herein with reference thereto. Such patents exemplify the general types of garments to which the manufacturing techniques may be applied. Other more specific forms will be described in detail hereafter.

In general, the aerobic resistance garment would be made from two different types of materials having different elastic characteristics. It is essential that one of the materials which functions as the elastic resistance elements or bands have a greater resistance force which must be overcome by the user while wearing the garment. The other material could have some degree of elasticity and could be made of the types of materials noted in the aforementioned patents. The base material for the garment would be selected so as to provide comfort to the user. Such material could be a stretch material having four-way or two-way stretch, preferably using a LYCRA spandex yarn. Other examples are DuPont's TACTEL and SUPPLEX. The elastic resistance material would have stretch in at least one direction and would require a greater force by the user to cause the stretch thereby enhancing the aerobic quality of the material. Reference is had to the aforenoted patents for examples of such materials for elastic resistance bands. A suitable material is a raschel knit containing lycra spandex.

The garment would include at pre-selected locations the elastic resistance bands. Generally, such bands have anchor structure in order to function as an aerobic garment. For example, where used in the shirt portion of the garment the anchor structure might be at the ends of the arms, such as at the hands or wrists. Where used in the pants portion of the garment the anchor structure might be at the legs or feet and might also be at the shoulders. Other locations of anchor structure might also be used with the practice of this invention. For example, a pants portion may terminate at the waist and anchor structure could be provided at the waist. A pants portion might also terminate in the general area of the knees and the anchor structure could be provided at, above or below the knees. With regard to the shirt portion the elastic band could extend from arm to arm with the anchor structure at each arm. Alternatively, the elastic band could extend from one arm to a further portion of the garment such as on the torso, neck or shoulder area and be provided with anchor structure at that area.

In general, the aerobic garment would be made by first designing the garment and determining the body dimensions. Next, the fabric would be selected and patterns would be made. Preferably the first sample would be cut and sewn and then fitted. After this testing any errors in the patterns would be corrected. A second sample would then be cut, sewn and fitted and corrections made for fit, function and patterns. The patterns would be graded and markers made. Specification sheets would be set up and sewing sheets would be created. Cutting tickets would be written and the final garments would be cut and sewn.

In general, the basic fabric would have its sections sewn together to form a base unit. The elastic aerobic bands would then be incorporated into the basic garment by being sewn at the appropriate locations to form a final garment section. A significant feature of the invention is that the elastic bands are designed so as to minimize the number of pieces required and to avoid seams across the direction of stretch which would otherwise interfere with the performance of the elastic resistance bands. A characteristic of such elastic resistance bands would be the high modulus required to return the bands when stretched. Thus, a physical exertion is required to stretch the bands and the muscles work to hold or restrain the bands when the bands attempt to return to their original unstretched size.

Figure 2:
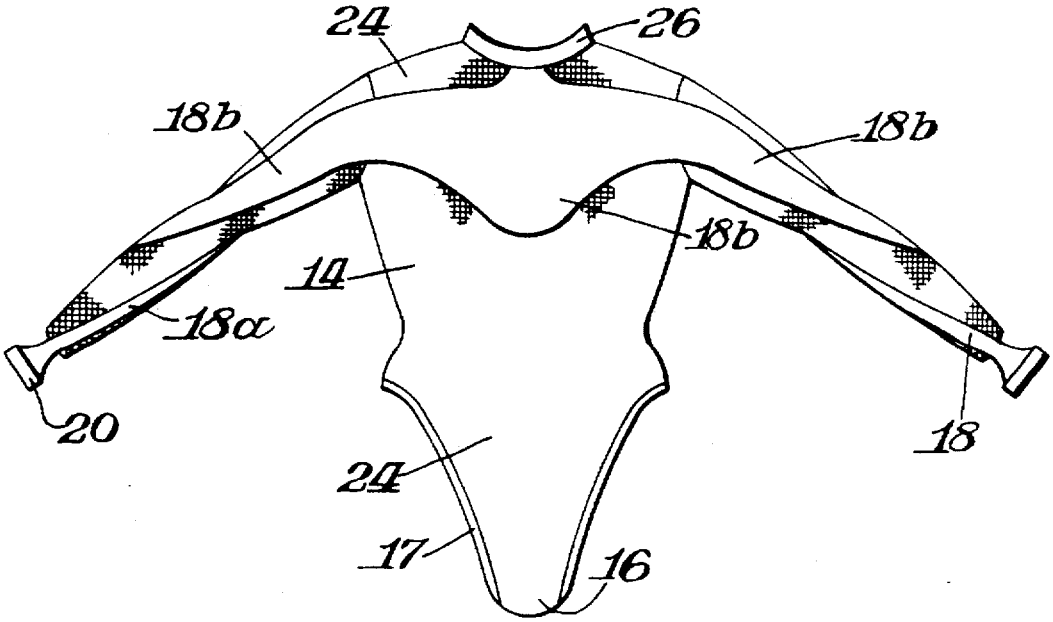
FIG. 2 is a rear elevational view of the garment shown in FIG. 1.

FIGS. 1–2 illustrate a shirt portion 10 of a final form of an elastic garment. In the form illustrated therein the shirt portion 10 is a body suit similar to leotards. Thus, shirt portion 10 would include a pair of arms 12,12 a body section 14 and a crotch area 16 with leg openings 17. An elastic resistance band 18 is provided on both the front and rear portions of the garment and with each band 18*a*,18*b* extending from arm to arm and being connected to a loop 20 into which the hand of the user would be on which could be a wrist loop inserted to anchor the elastic band 18. As shown in FIG. 1 the front the band 18 may be interrupted by a zipper 22 which is provided to permit the garment to be easily put on or removed. Where a zipper or other attaching elements are used the full benefits of the elastic band may not be obtained since the location of the zipper is across the direction of stretch of the elastic band. An intent of the invention is to minimize any interference, such as by seams, with the performance of the elastic resistance bands.

Figure 3B:
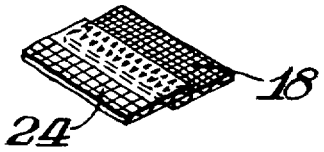
FIGS. 3A and 3B are perspective views showing the elastic band stitched to the base fabric.
Figure 3A:
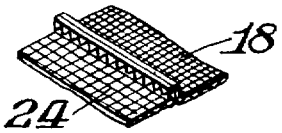

FIG. 3 shows how the elastic resistance band material 18 is stitched to the base fabric 24. The stitching occurs at locations which do not extend across the direction of stretch of the elastic bands. This is a preferred characteristic of the invention to enhance the performance of the garment. As illustrated in FIGS. 1–2 rear band 18*b* rotates around the front of the wrist. Front resistance band 18*a* goes down the arms and terminates underneath the wrists.

Figure 4:
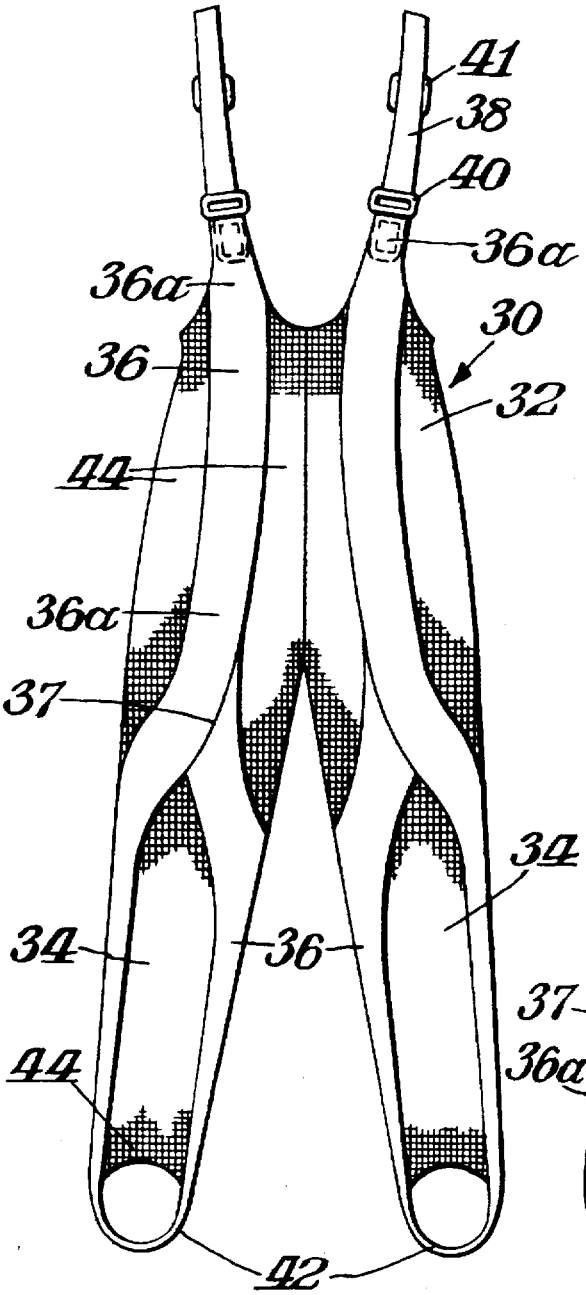
FIG. 4 is a front elevational view of a pants section for an aerobic resistance garment made in accordance with this invention.
Figure 5:
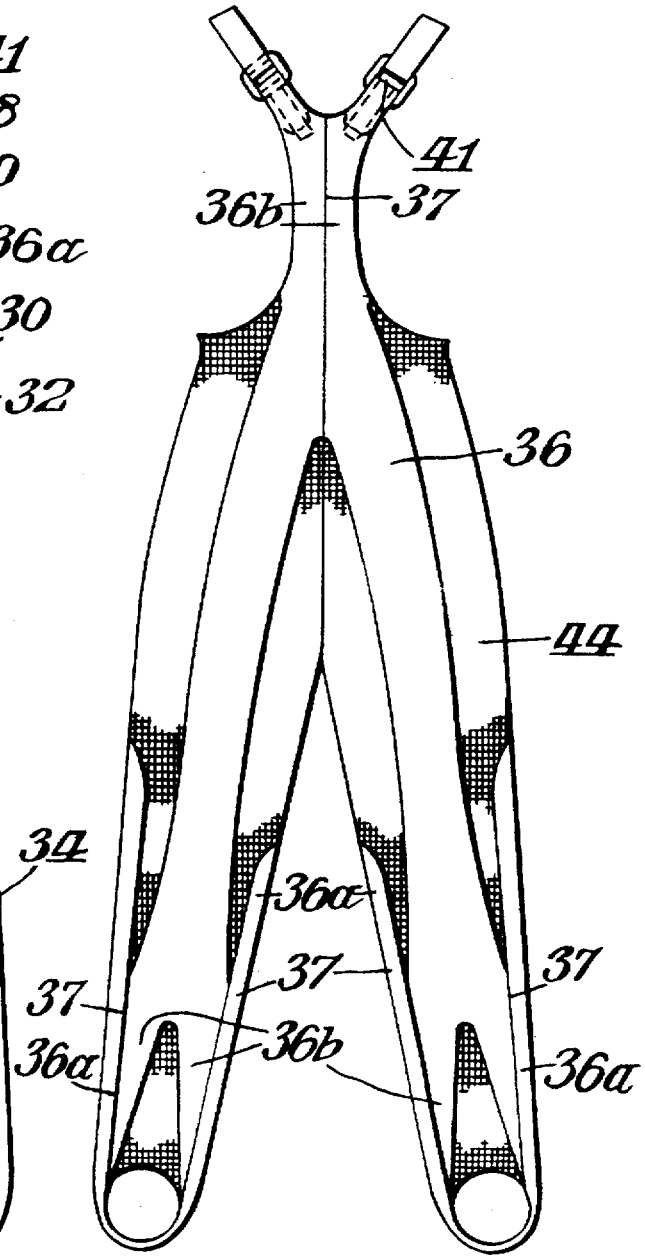
FIG. 5 is a rear elevational view of the pants section shown in FIG. 1.

FIGS. 4–5 illustrate a pants section 30 for the aerobic exercise garment. As shown therein the pants section 30 would have a body portion 32 and leg portions 34. Elastic resistance bands 36 are provided on the leg portions and extend upwardly from the body portion 32 to form suspenders 38. The base fabric is indicated by the reference numeral 44. As later described buckles or other adjusting devices 40 would also be provided to permit the proper fit to be attained by the user. As illustrated in FIGS. 4–5 the elastic resistance bands 36 also form loops or stirrups 42 which would function as anchor elements at one end of the pants with the suspenders being placed over the shoulders functioning as anchor elements at the other end of the pants.

Figure 6:
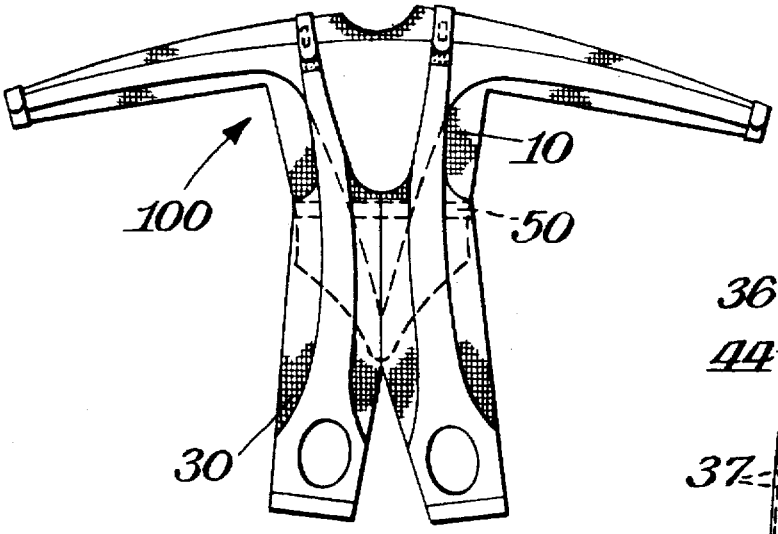
FIG. 6 is a front elevational view showing both garments of FIGS. 1–2 and FIGS. 4–5 assembled into a combined product.

If desired each of the shirt portion 10 and the pants portion 30 may be worn separately to function as an individual aerobic exercise garment. Alternatively, as shown in FIG. 6 the shirt portion 10 and pants portion 30 may be worn together to form a combined exercise garment 100. When worn together the shirt portion 10 and pants 30 may be secured together by any suitable attaching structure 50 such as detachable elements including, but not limited to, clips, buttons, VELCRO® or maybe permanently attached by stitching or other suitable means.

As shown in FIG. 1 the elastic resistance bands 18 on the front of the shirt 10 includes two separate elastic bands 18*a*,18*a* which extend from the central portion of the body 14 completely to and beyond the ends of the arms 12. The two elastic bands 18*a*,18*a* are secured together by zipper 22. As shown in FIG. 2 the elastic resistance band on the back of the shirt is a single elastic band 18*b* which extends from arm to arm completely across the body portion 14 of the shirt. Each elastic strip or band 18*a*,18*b* is connected to a band of cushioning material such as neoprene which forms a closed loop by any suitable detachable fasteners such as buckles, clips or VELCRO® so as to provide anchor structure for the elastic bands. If desired the loop 20 could be a permanently closed loop made of elastic material to function as a compression band which would accommodate various sizes of users.

As shown in FIG. 4 pants 30 includes on its front side a first set of elastic bands 36*a*,36*a* which extend from the suspenders and down the pants to a location slightly above the knee. The elastic resistance band 36*a* then shifts its direction toward the outside and continues down the leg forming the loop 42 and then continues up the leg where it terminates and is secured to itself by the seam 37. As can be appreciated the seam 37 is at a location which is not across and thus does not interfere with the direction of stretch of the elastic resistance band 36*a*. As should also be appreciated this arrangement permits the use of a single piece of elastic resistance band fabric to be used on the front side of pants 30 for each leg 34.

FIG. 4 illustrates the back side of the pants 30. As shown therein a second pair of elastic bands 36*b*,36*b* is provided which extends from the suspenders and runs the length of the body portion to a location below the knee where each band bifurcates and then is joined to a corresponding portion of the front band 36*a*.

The bifurcated portions of elastic band 36*b* are sewn to front band 36*a* by stitching 37. The individual elastic bands 36*b*,36*b* are sewn together in the suspenders portion of the pants by stitching 37. Thus, all of the stitching of the elastic band is at a location which does not interfere with the direction of resistance of the elastic bands.

The extended portions of bands 36*a* and 36*b* are connected together to form the suspenders 38. If desired, each band 36*b*,36*b* may be permanently sewn or connected to a loop member 41 as shown in FIG. 5, by extending around the member 41 and being sewn to itself. The opposite bands 36*a*,36*a* may extend through a double slotted buckle 40 and then through the loop member 41. The end of each band 36*a*,36*a* may then be sewn to itself thereby providing a loop structure between buckle 40 and loop member 41. This provides adjustability in the effective length of the suspenders 38. Padding may be provided on the underside of the portion of bands 36*a*,36*a* which comprise their part of the suspenders 38.

In making the shirt portion 10 the front and back crotches are sewn together with the crotch liner extending wrong side up on the back. Next, the side seams of the body are sewn together to form a basic unit. The crotch liner is flipped over to the front. Elastic is stitched to the legs, turned and coverstitched and the underarms are sewn to the body portion. The upper arms are sewn to the shoulders. The front elastic bands 18*a* are sewn to the shoulders/upper arms and the back elastic band 18*b* is also sewn to the shoulders/upper arms.

In making the shirt portion 10 the process continues with the running of a binding or sewing of a collar 26 to the neck. The collar could also include appropriate labels. Zipper 22 is sewn to the center front joining the patterns for the fabric 24 and the elastic band 18. The zipper is topstitched. The front and back bands 18 are then sewn to the body and lower arms. Seam allowance is turned at the sides of the hands (i.e. the bottom of the arm) and coverstitched. The inner edge of the hands are stitched together. Next, neoprene bands or strips are coverstitched which would form the loops 20. VELCRO® hook fabric is sewn to the top of the neoprene bands with the neoprene bands sewn at the bottom edges of the hands or ends of the sleeves and with the VELCRO® hook located at the outer edge of the hands on the neoprene (or other suitable material) bands, so that the loop 20 could be adjustably formed in accordance with the proper circumferential dimension of the proper user.

FIGS. 4–5 are now referred to with regard to the making of the pants section 30. The center back legs fabric 44 and back bands fabric 36 would be sewn together. Next, the back bands 36*b* would be sewn together from above the crotch to the center back. The left and right sides would be sewn to the back bands 36*b*. The center front rises are sewn together and the upper front legs are sewn to the upper back legs. Then, the top of the back ankle inserts are sewn between notches to the bottom of the back bands 36b. The inner edge of the front ankle inserts are sewn to the short edge of the short curved section of the front bands 36a. The upper edge of the short curved section of the front band 36a is sewn to the front inner thigh, inner edge of back band 36b and back ankle insert. Then the inner edge of the front bands is sewn from the waist to the foot picking up the other end of the bands 36a and outer edge of the front ankle inserts. The outer edge of the bands 36a is sewn to side panels picking up the lower edges of the back bands and outer edge of the back ankle inserts. Then, the openings of stirrup 42 are coverstitched. A ⅜ inch elastic strip is sewn to the outer edge of the back band 36b along the sides to the front notch above the waist then a ⅜ inch rubber elastic strip is sewn to the center back edges (inner edges of Y) at the top of the back bands 36b. The ⅜ inch elastic is turned and coverstitched with labels at the center of the back. The strap portions of bands 36a above the ⅜ inch elastic are turned and sewn on top of a 1½ inch elastic strip. A folder could be used if desired. The ends of the back and front straps 38 are overlocked. Next, bar tack the intersection of the Y and the labels. Loops 41 are sewn at the ends of the back Y. Finally, loops 41 are sewn on the front bands.

It is to be understood that the manufacturing techniques described above may also be adapted for making aerobic exercise suits of different configurations than those specifically illustrated herein.

Tests were conducted on the two piece suit 100 to compare the metabolic changes that occur during treadmill walking while wearing the suit in comparison to standard exercise apparel. The following are the test results:

Subject Selection

A well-conditioned 56-year-old professional male subject (maximum oxygen consumption=47 ml $kg^{-1}$ $min^{-1}$, height=69", weight=168 lbs) with over 160 treadmill test experiences served as the subject for this investigation. To accurately test the garment 100, it was necessary to have a subject who knew how to precisely duplicate the arm and leg mechanics for both the control conditions (NPGS=No Power Garment Suit 100) and the experimental Power Garment Suit 100 conditions (PGS) during each submaximal treadmill test. It was critical to have a reliable test conducted each time to reduce test-to-test variability under the control as well as the experimental suit 100 conditions.

Test Protocol and Parameters Monitored

A modified McHentry treadmill protocol was used. In this study the speed remained constant at 3.6 mph, and three Stages for 9 minutes at a 0% grade, then 3 minutes at 3% and then 3 minutes at 6% grade were used. The typical surfaces upon which people walk range between 0% to 6%.

A single-lead telemetry ECG was used to monitor exercise heart rates, and a MedGraphics 2000 gas analysis system was used to measure the metabolic oxygen cost of the exercise throughout each test. The sustained 9-min workload at 3.5 mph/0% grade was used to reflect the recommended speed used during fitness walking programs. The two additional percent grades are commonly encountered by fitness walkers within the confines of their local neighborhoods.

Oxygen consumption represents the amount of oxygen in milliliters per kilogram (2.2 lbs) of body weight (ml $kg^{-1}$ $min^{-1}$) required by the human body to conduct its metabolic activity during various levels of muscular effort. Energy producing organelles (mitochondria) in skeletal muscle tissue increase their oxygen requirements to reduce sugar and fat to a usable energy source called ATP (adenosinetriphosphate) as the muscles are increasingly stressed. By assessing the oxygen requirements of the body at any given moment, it is possible to evaluate the effects of the suit 100 on the muscular efforts of the body, and more importantly, the metabolic cost of exercising in the suit 100.

Results of the Investigation

In this investigation, the suit 100 used during treadmill walking at 3.5 mph/0.% grade produced a 33.37% greater metabolic response than did the standard exercise apparel (control garments) which included a cotton T-shirt, sneakers, socks and tennis shorts. The average oxygen consumption value of 21.74 ml $kg^{-1}$ $min^{-1}$ during the suit 100 use at 3.5 mph/0% grade in this investigation was greater than the values reported in the following published studies in which subjects carried varying sizes of hand-held weights (HHWs).

Zarandona et al (*Physician and Sports Medicine,* 14(10): 113–120, October 1986) tested 30 trained men who carried either no HHWs, 1-lb weights, or 5-lb weights in both hands while treadmill walking at 3.5 mph/0% grade. They reported statistically significant values of 15.05 and 19.00 ml $kg^{-1}$ $min^{-1}$ while using 1-lb and 5-lb HHWs respectively. Other authors have also reported statistically significant increase in metabolic cost when their subjects were using 1-lb and 3-lb HHWs. See *Medicine and Science in Sports and Exercise,* 19(3): 260–265, June 1987 and *Research Quarterly,* 63(4): 435–437, December 1992.

Table 1 reports the oxygen consumption cost of walking at 3.5 mph/0% grade while wearing the suit 100.

TABLE 1

$VO^2$ ml $kg^{-1}$ $min^{-1}$ difference and % increase for NPGS* PGS** conditions during 3.5 mph/0% grade treadmill walking

| NPGS | PGS | Difference | % increase |
|---|---|---|---|
| 16.30 | 21.74 | 5.44 | 33.37 |

*NPGS = no power garment suit
**PGS = power garment suit 100

CONCLUSIONS

1. The suit 100 produced a 33.37% greater increase in the metabolic cost of walking at 3.5 mph/0% grade than standard aerobic exercise apparel (cotton T-shirt, socks, sneakers, and tennis shorts).

2. In comparison to published hand-held weight studies, walking at 3.5 mph/0% grade while wearing the suit 100 produces a metabolic cost in oxygen consumed per minute that is 14.42% greater than when carrying two 5-lb hand-held weights while walking at the same speed and grade.

3. The built-in resistance bands of the suit 100 eliminate the need for carrying hand-held weights that involve isometric gripping which is known to cause elevated blood pressures.

Figure 7:
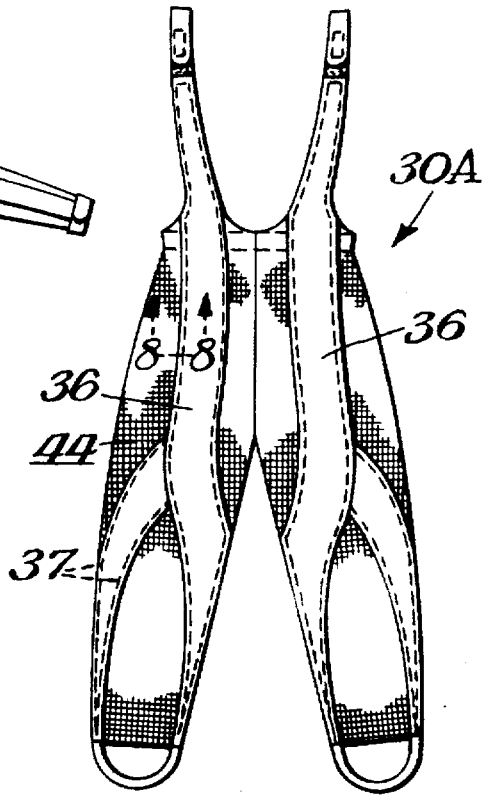
FIG. 7 is a front elevational view of a modified aerobic exercise garment in accordance with this invention.
Figure 8:
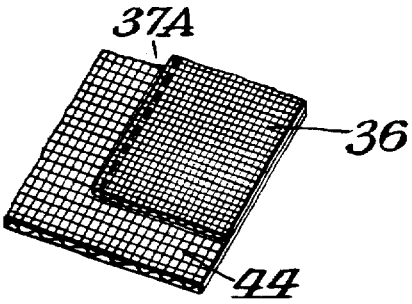
FIG. 8 is a cross-sectional view taken through FIG. 7 along the line 8—8.

The invention has been particularly described with respect to FIGS. 1–6 wherein the elastic resistance bands form panels which separate and are joined to base fabric material. The invention may also be practiced where the base fabric material in itself is a complete garment such as a shirt, pants, etc. and the elastic resistance bands are sewn on top of or below the base fabric. FIGS. 7–8, for example, illustrate a pants 30A of generally the same structure as pants 30 except that the elastic bands 36 are formed directly over the base fabric. This is shown, for example, in FIG. 8 where the elastic band material 36 is superimposed over (or below if desired) the fabric 44 and secured thereto by stitching 37A.

It is also to be understood that the invention may be practiced with forms of garments other than specifically described herein. For example, the pants may be short pants, particularly adapted for warm weather or indoor use and the base fabric may be made of a mesh material. A further variation would be to form the pants portion as a wrestler's suit which in turn incorporates the elastic bands in the manner herein described.

What is claimed is:

1. An aerobic resistance garment including a body portion and limb sections, said garment being made from a plurality of segments of base material, a plurality of elastic resistance bands secured to said base material, each elastic resistance band having an anchor structure, said elastic resistance bands having a direction of stretch which causes the user to exert a force in stretching said elastic resistance bands and in resisting said elastic resistance bands returning to their unstretched condition, and said elastic resistance bands being secured to said base material in an arrangement wherein pairs of said segments of base material are spaced from each other and connected together by being connected to one of said elastic resistance bands therebetween.

2. The garment of claim 1 wherein said garment includes a shirt portion and said limb sections are arm sections, said elastic resistance band being a one piece member extending across said body section completely from one of said arm sections to the other of said arm sections, said elastic resistance band being secured to a loop member outwardly of each of said arm sections, and said loop member being said anchor structure.

3. The garment of claim 2 including further elastic resistance bands on said shirt portion on a side thereof opposite said one piece resistance band, and said further resistance bands extending across said body portion from one of said arms to the other of said arms and being connected to said loop member.

4. The garment of claim 1 wherein said garment further includes a pants having legs as said limb sections, said pants having a front and a rear and a top, a set of said elastic bands being on said front of said pants extending from said top of said pants down said legs, and a set of said elastic resistance bands being on said rear of said pants extending downwardly from said body portion to said legs.

5. The garment of claim 2 wherein said garment further includes a pants having legs as said limb sections, said pants having a front and a rear and a top, a front set of said elastic resistance bands being on said front of said pants extending from said top of said pants down said legs, and a rear set of said elastic resistance bands being on said rear of said pants extending downwardly from said body portion to said legs.

6. An aerobic resistance garment including a body portion and limb sections, said garment being made from a base material, at least one elastic resistance band secured to said base material, said elastic resistance band having an anchor structure, said elastic resistance band having a direction of stretch which causes the user to exert a force in stretching said elastic resistance band and in resisting said elastic resistance band returning to its unstretched condition, said elastic resistance band being secured to said base material at locations which minimize any interference with the movement of said elastic resistance band along said direction of stretch, said garment including a shirt portion and said limb sections being arm sections, said elastic resistance band being a one piece member extending across said body section completely from one of said arm sections to the other of said arm sections, said elastic resistance band being secured to a loop member outwardly of each of said arm sections, said loop member being said anchor structure, further elastic resistance bands on said shirt portion on a side thereof opposite said one piece resistance band, said further resistance bands extending across said body portion from one of said arms to the other of said arms and being connected to said loop member, and said further resistance bands being connected to each other on said body portion by a zipper.

7. An aerobic resistance garment including a body portion and limb sections, said garment being made from a base material, at least one elastic resistance band secured to said base material, said elastic resistance band having an anchor structure, said elastic resistance band having a direction of stretch which causes the user to exert a force in stretching said elastic resistance band and in resisting said elastic resistance band returning to its unstretched condition, said elastic resistance band being secured to said base material at locations which minimize any interference with the movement of said elastic resistance band along said direction of stretch, said garment including a shirt portion and said limb sections being arm sections, said elastic resistance band being a one piece member extending across said body section completely from one of said arm sections to the other of said arm sections, said elastic resistance band being secured to a loop member outwardly of each of said arm sections, said loop member being said anchor structure, and said loop member being a loop made of a cushioning material.

8. An aerobic resistance garment including a body portion and limb sections, said garment being made from a base material, at least one elastic resistance band secured to said base material, said elastic resistance band having an anchor structure, said elastic resistance band having a direction of stretch which causes the user to exert a force in stretching said elastic resistance band and in resisting said elastic resistance band returning to its unstretched condition, said elastic resistance band being secured to said base material at locations which minimize any interference with the movement of said elastic resistance band along said direction of stretch, said garment including a shirt portion and said limb sections being arm sections, said elastic resistance band being a one piece member extending across said body section completely from one of said arm sections to the other of said arm sections, said elastic resistance band being secured to a loop member outwardly of each of said arm sections, said loop member being said anchor structure, said garment further including a pants having legs as said limb sections, said pants having a front and a rear and a top, a front set of said elastic bands being on said front of said pants extending from said top of said pants down said legs, a rear set of said elastic resistance bands being on said rear of said pants extending downwardly from said body portion to said legs, said elastic bands on said front of said pants comprises two elastic bands, each of said two elastic bands extending from said body portion and down said body portion to a location generally at a knee section of its said leg, and said band and then being offset as it continues down said leg to form a loop beyond said leg and then continues upwardly to be secured to itself.

9. The garment of claim 8 wherein said elastic bands further includes a second set of elastic bands on the rear of said pants portion, and said second set of said elastic bands comprising two bands each of which extends from above said body portion downwardly of said body portion to said leg portion and then bifurcates in the general area of the knee, where it is secured to said front elastic bands.

10. The garment of claim 9 wherein said set of rear elastic bands of said pants is secured to itself from a location above the crotch to a location above said body portion and then diverges to form a Y, said front elastic bands and said rear elastic bands of said pants being secured together beyond said body portion to form suspenders.

11. The garment of claim 10 wherein said suspenders are adjustable in length.

12. An aerobic resistance garment including a shirt portion in the form of leotards having arm sections and a body portion and a crotch portion, said garment being made from a base material, at least one elastic resistance band secured to said base material on each of arm sections, said elastic resistance band having an anchor structure at the end of each of said arm sections, said elastic resistance bands having a direction of stretch which causes the user to exert a force in stretching said elastic resistance bands and in resisting said elastic resistance bands returning to their unstretched condition, and said elastic resistance bands being secured to said base material at locations which minimize any interference with the movement of said elastic resistance bands along said direction of stretch.

13. The garment of claim 12 wherein said elastic band is located between and secured to separate portions of said base material.

14. The garment of claim 12 wherein said elastic resistance band is secured in an overlapping manner to said base material.

15. The garment of claim 12 wherein said leotards has a front and a rear, said resistance bands comprising a first resistance band extending from arm to arm and across said front and a second resistance band extending from arm to arm and across said rear.

16. The garment of claim 15 wherein said garment further includes a pants having legs, said pants having a front and a rear and a top, a front set of said elastic bands being on said front of said pants extending from said top of said pants down said legs, and a rear set of said elastic resistance bands being on said rear of said pants extending downwardly from said top of said pants to said legs.

17. The garment of claim 16 wherein said set of rear elastic bands of said pants portion is secured to itself from a location above the crotch and then diverges to form a Y, and said front elastic bands and said rear elastic bands of said pants portion being secured together to form suspenders.

18. The garment of claim 17 wherein said suspenders are adjustable in length.

19. The garment of claim 15 wherein said first and said second resistance bands are connected to each other at the end of each arm by being connected to a common loop at the end of each arm.

20. An aerobic resistance garment including a body portion and limb sections, said garment being made from a base material, at least one elastic resistance band secured to said base material, said elastic resistance band having an anchor structure, said elastic resistance band having a direction of stretch which causes the user to exert a force in stretching said elastic resistance band and in resisting said elastic resistance band returning to its unstretched condition, said elastic resistance band being secured to said base material at locations which minimize any interference with the movement of said elastic resistance band along said direction of stretch, said garment further including a pants having legs as said limb sections, said pants having a front and a rear and a top, a set of said elastic bands being on said front of said pants extending from said top of said pants down said legs, and a set of said elastic resistance bands being on said rear of said pants extending downwardly from said body portion to said legs, said elastic bands on said front of said pants comprising two elastic bands, each of said two elastic bands extending from said body portion and down said body portion to a location generally at a knee section of its said leg, and said band then being offset as it continues down said leg to form a loop beyond said leg and then continues upwardly to be secured to itself.

21. The garment of claim 20 wherein said elastic bands further includes a second set of elastic bands on the rear of said pants said second set of said elastic bands comprising two bands each of which extends from above said body portion downwardly of said body portion to said leg portion and then bifurcates in the general area of said knee section where it is secured to said front elastic bands.

22. The garment of claim 20 wherein said set of rear elastic bands of said pants is secured to itself from a location above the crotch to a location above said body portion and then diverges to form a Y, said front elastic bands and said rear elastic bands of said pants being secured together beyond said body portion to form suspenders.

23. The garment of claim 22 wherein said suspenders are adjustable in length.

24. An aerobic resistance garment including pants having a body portion and legs extending downwardly from said body portion, said pants having a front and a rear and a top, said garment being made from a base material, elastic resistance bands secured to said base material, said elastic resistance bands having anchor structure, said elastic resistance bands having a direction of stretch which causes the user to exert a force in stretching said elastic resistance bands and in resisting said elastic resistance bands returning to their unstretched condition, said elastic resistance bands being secured to said base material at locations which minimize any interference with the movement of said elastic resistance bands along said direction of stretch, a set of said elastic bands being on said front of said pants extending from said top of said pants down said legs, a set of said elastic resistance bands being on said rear of said pants extending downwardly from said body portion to said legs, said set of rear elastic bands of said pants portion being secured to itself from a location above the crotch then diverging to form a Y, and said front elastic bands and said rear elastic bands of said pants portion being secured together to form suspenders.

25. The garment of claim 24 wherein said suspenders are adjustable in length.

26. The garment of claim 7 wherein said loop is adjustable.

* * * * *

UNITED STATES PATENT AND TRADEMARK OFFICE

Certificate

Patent No. 5,737,773 Patented: April 14, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Timothy P. Dicker; William T. Wilkinson; and Susannah N. Archinal.

Signed and Sealed this Twenty-First Day of March, 2000.

JOHN C. CALVERT
Supervisory Patent Examiner,
Art Unit 3741